US006308469B1

(12) United States Patent
Leung

(10) Patent No.: US 6,308,469 B1
(45) Date of Patent: Oct. 30, 2001

(54) SHEAR WALL PANEL

(75) Inventor: Thomas Leung, Vancouver (CA)

(73) Assignee: Shear Force Systems Inc., Maple Ridge (CA)

( * ) Notice: Subject to any disclaimer, the term of this patent is extended or adjusted under 35 U.S.C. 154(b) by 0 days.

(21) Appl. No.: 09/419,934

(22) Filed: Oct. 18, 1999

(30) Foreign Application Priority Data

Oct. 15, 1999 (CA) ..... 2285890

(51) Int. Cl.[7] ..... E04B 2/70; E04H 9/02; E04H 9/14

(52) U.S. Cl. ..... 52/167.3; 52/293.3; 52/481.1; 52/693; 52/712; 411/466

(58) Field of Search ..... 52/167.1, 167.3, 52/693, 293.3, 657, 481.1, 712, 714, 715; 411/461, 462, 463, 464, 465, 466, 467, 468, 921

(56) References Cited

U.S. PATENT DOCUMENTS

| | | | | |
|---|---|---|---|---|
| 1,622,962 | * | 3/1927 | Michod | 52/693 |
| 2,051,191 | * | 8/1936 | Watson | 411/461 X |
| 2,191,804 | | 2/1940 | O'Malley . | |
| 3,143,194 | | 8/1964 | Hart . | |
| 3,423,894 | | 1/1969 | Richardson . | |
| 3,594,965 | | 7/1971 | Saether . | |
| 3,822,521 | | 7/1974 | Lucas . | |
| 3,871,149 | | 3/1975 | Georgii . | |
| 4,074,487 | | 2/1978 | Daniels et al. . | |
| 4,198,175 | * | 4/1980 | Knepp et al. | 52/702 X |
| 4,321,776 | | 3/1982 | Delight . | |
| 4,455,805 | * | 6/1984 | Rionda et al. | 52/712 |
| 4,486,115 | * | 12/1984 | Rionda et al. | 403/283 |
| 4,525,972 | * | 7/1985 | Palacio et al. | 52/714 X |
| 4,561,230 | * | 12/1985 | Rionda et al. | 52/712 X |
| 4,578,909 | | 4/1986 | Henley et al. . | |
| 4,587,787 | | 5/1986 | King . | |
| 4,603,531 | | 8/1986 | Nash . | |
| 4,633,634 | | 1/1987 | Nemmer et al. . | |

(List continued on next page.)

FOREIGN PATENT DOCUMENTS

| | | | | |
|---|---|---|---|---|
| 15051 83 | | 12/1983 | (AU) . | |
| 2238876 | * | 5/1998 | (CA) . | |
| 2224400 | | 7/1998 | (CA) . | |
| 2238876 | | 12/1998 | (CA) . | |
| 0 918 114 A2 | | 5/1999 | (EP) . | |
| 2244588 | | 5/1999 | (CA) . | |
| 1274688 | * | 5/1972 | (GB) | 411/466 |
| 1281801 | * | 7/1972 | (GB) | 411/466 |
| WO 98 46839 | | 10/1998 | (WO) . | |

OTHER PUBLICATIONS

"Fine Homebuilding", Jeff Arkin, Earthquake–Country Timber Frame: Jun., 1987, pp. 43–45.

*Primary Examiner*—Laura A. Callo
(74) *Attorney, Agent, or Firm*—Bereskin & Parr

(57) ABSTRACT

A shear wall panel for a building has a rectangular frame of vertical and horizontal members. Inside of the rectangular frame, at least four diagonal members are joined at their ends to create a multi-segmented assembly having at least three vertices and first and second ends and preferably forming a polygon, one of the at least three vertices secured to each of the vertical and an upper horizontal members, the first and second ends secured to a lower horizontal member. The members are preferably of wood and connected together with toothed plates. A lower horizontal member is shear connected to a foundation or laterally stabilized wall or floor below the shear wall panel. Upper strap connectors attach the upper horizontal member to a roof, floor or wall of the building. The upper strap connectors comprises metal straps, a first portion of which have teeth bent out of the metal strap, a second portion of which have holes for nailing through the metal strap into the roof, floor or wall of the building.

17 Claims, 7 Drawing Sheets

U.S. PATENT DOCUMENTS

| | | | | |
|---|---|---|---|---|
| 4,706,436 | | 11/1987 | Mabey et al. . | |
| 4,738,071 | * | 4/1988 | Ezard | 52/712 X |
| 4,875,314 | | 10/1989 | Boilen . | |
| 4,937,993 | | 7/1990 | Hitchins . | |
| 5,095,671 | | 3/1992 | Mitani . | |
| 5,218,804 | | 6/1993 | Campbell . | |
| 5,333,426 | | 8/1994 | Varoglu . | |
| 5,384,993 | * | 1/1995 | Philips | 52/293.3 |
| 5,505,031 | | 4/1996 | Heydon . | |
| 5,524,400 | | 6/1996 | Schmechel . | |
| 5,536,541 | | 7/1996 | Armellini . | |
| 5,657,606 | | 8/1997 | Ressel et al. . | |
| 5,706,626 | | 1/1998 | Mueller . | |
| 5,768,851 | | 6/1998 | Nagaoka . | |
| 5,782,047 | | 7/1998 | De Quesada . | |
| 5,782,054 | | 7/1998 | Varoglu et al. . | |
| 5,833,421 | * | 11/1998 | Lees | 411/466 |
| 5,867,963 | * | 2/1999 | Hershey | 52/693 |
| 5,904,025 | | 5/1999 | Bass et al. . | |
| 6,073,413 | * | 6/2000 | Tongiatama | 52/693 |
| 6,158,184 | * | 12/2000 | Timmerman, Sr. et al. | 52/293.3 |

* cited by examiner

SHEAR WALL PANEL

FIELD OF THE INVENTION

This invention relates to shear walls and, more particularly, to a prefabricated shear wall panel for use in frame construction.

BACKGROUND OF THE INVENTION

Shear walls or shear wall panels are used to resist lateral forces in a structure created, for example, by wind loads applied to the side of a structure or earthquakes. Conventional shear walls typically fall into three categories: (a) braced frames, (b) moment frames and (c) frames with structural sheathing.

In braced frames, a stud wall has braces which extend diagonally from a rim joist or plate at the top of the wall to a rim joist, plate or foundation at the bottom of the wall. The braces cross one or more of the studs and therefore requires cuts in the studs to let the bracing into the wall or finish materials which can accommodate the protruding bracing member. In order to avoid cutting the studs significantly or to minimize how far the brace protrudes from the wall, the braces are typically made of a steel strip or rod or a thin wooden board. Since the bracing member is longer than the wall studs, the slenderness of the bracing member limits its compressive strength and so the bracing members are installed in pairs slanting in opposite directions to provide a tensile member to resist lateral forces in either direction. In addition to these shortcomings, the braces typically occupy significant lengths of the walls which are then unavailable for windows.

In moment frames, various corners between studs and plates or joists are reinforced, typically with triangular steel plates or wooden knees. With the corners reinforced, lateral movement is resisted by moment in the studs which must bend before one of their ends can be displaced laterally while remaining vertical. This method may be suitable for timber frame or large I-beam structures in which the studs have large cross sections, but is inefficient when applied to light framing using "2 by" lumber or light metal channels. In these applications, the studs have limited moment resistance and large numbers of stud to plate or joist connections must be reinforced.

In frames with structural sheathing, plywood or oriented strand board is nailed to the studs and any sills, headers etc. used to frame openings. The sheathing panels are resistant to lateral deformation. When properly attached to the wall, the sheathing panels transfer this resistance to the wall primarily as a shear force around the perimeter of the sheathing panel. To resist this shear force, a concentrated nailing pattern is required around the perimeter of the sheathing panel. Any openings for windows require more intensive nailing and yet still weaken the panel such that some building codes deem sections of the wall with openings to have no lateral resistance. The process is time consuming and heavily dependant on quality workmanship. Further, in recent years it has been discovered that the tightly nailed sheathing panels in combination with an interior vapour barrier trap moisture within the wall which often leads to fungus growth and premature failure of the wall.

SUMMARY OF THE INVENTION

It is an object of the present invention to provide a shear wall panel suitable for light framing, particularly in wood. It is a further object of the present invention to provide such a shear wall panel that does not require structural sheathing, that is suitable for pre-assembly in a factory, and presents reduced interference with placing windows in the structure.

The invention is directed at a shear wall panel for a building comprising, a) a pair of spaced apart vertical members having upper ends and lower ends;

b) an upper horizontal member extending between and secured to the upper ends of the vertical members;

c) a lower horizontal member extending between and secured to the lower ends of the vertical members;

d) at least four diagonal members joined end to end in a multi-segmented assembly having at least three vertices between a first end and a second end, wherein the multi-segmented assembly is located inside of the members in a), b) and c) above; one of the at least three vertices is secured to each of the members in a) and b) above; and, the first end and second ends are secured to the lower horizontal member.

The lower horizontal member is shear connected to a foundation or laterally stabilized wall or floor below the shear wall panel. The shear connection includes vertically oriented connectors connected to the lower ends of the vertical members to resist upward tensile forces on the vertical members. In an embodiment, these vertically oriented connectors are wooden thrust blocks, preferably oriented so that the grain of the wood is vertical with a hole through the thrust blocks to accept a rod extending upwards from the foundation or a laterally stabilized wall or floor of the building below the shear wall panel.

Upper connectors transfer shear and tensile forces from a roof, floor or wall of the building above the upper horizontal member to the shear panel. In an embodiment, the upper shear connectors comprise metal straps, a first portion of which have teeth bent out of the metal strap, a second portion of which have holes for nailing through the metal strap into the roof, floor or wall of the building. Tensile metal straps have teeth whose width is parallel to a line dividing the first portion of the metal strap from the second portion of the metal strap. Shear metal straps have teeth whose width is perpendicular to a line dividing the first portion of the metal strap from the second portion of the metal strap The invention is further directed at a shear wall panel as described above having wooden members attached to each other with toothed plates pounded through the members. The upper horizontal member preferably has a notch or extends beyond a vertical member so that the shear wall panel may be connected to the upper plates or upper horizontal members of adjacent wall panels.

The invention is further directed at a metal strap for connecting substantially abutting wooden members comprising, (a) a first portion of the metal strap having teeth bent out of the metal strap; and, (b) a second portion of the metal strap having holes for nailing through the metal strap. An embodiment has teeth whose width is parallel to a line dividing the first portion of the metal strap from the second portion of the metal strap. Another embodiment has teeth whose width is perpendicular to a line dividing the first portion of the metal strap from the second portion of the metal strap.

BRIEF DESCRIPTION OF THE DRAWINGS

Embodiments of the present invention will be described with reference to the following drawings.

DESCRIPTION OF PREFERRED EMBODIMENTS

Figure 1:
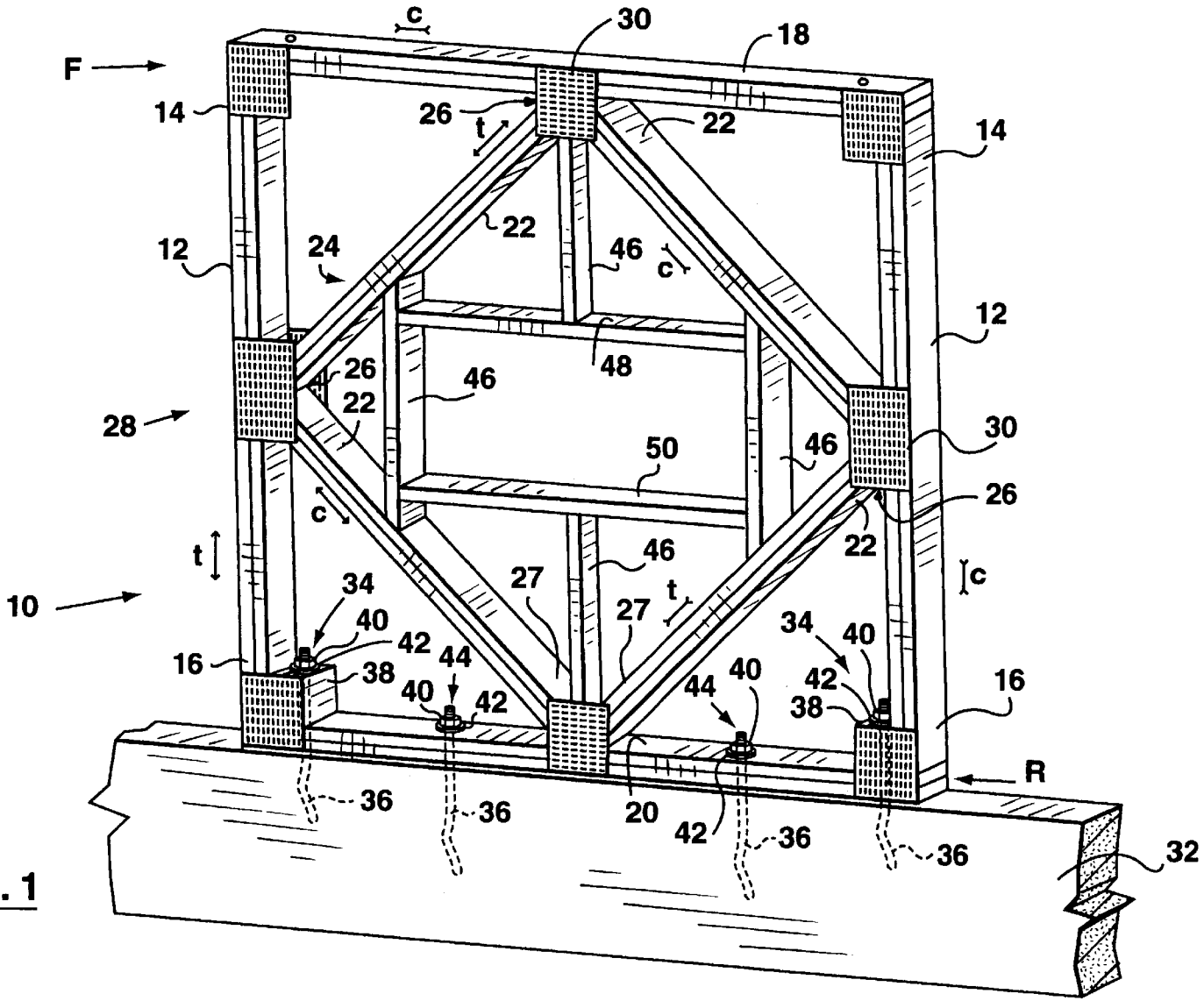
FIG. 1 is a perspective view of a shear wall panel according to an embodiment of the invention.

Referring now to FIG. 1, a shear wall panel 10 for a building is shown. The shear wall panel 10 has a pair of spaced apart vertical members 12 having upper ends 14 and lower ends 16. An upper horizontal member 18 extends between and is secured to the upper ends 14 of the vertical members 12. A lower horizontal member 20 extends between and is secured to the lower ends 16 of the vertical members 12. Four diagonal members 22 are joined end to end to create a multi-segmented assembly 24 inside of the rectangle formed by the vertical members 12, upper horizontal member 18 and lower horizontal member 20. The multi-segmented assembly 24 has three vertices 26, each attached to one of the vertical members 12 or the upper horizontal member 18, preferably at their midpoint. The multi-segmented assembly 24 also has first and second ends 27 attached to the lower horizontal member 20. In the embodiment shown in FIG. 1, the first and second ends 27 are joined to each other so that the multi-segmented assembly 24 is a polygon. In such cases, the first and second ends 27 are preferably joined to the lower horizontal member 20 at its midpoint.

The shear wall panel 10 is adapted for use in a light timber frame. The vertical members 12, upper horizontal member 18, lower horizontal member 20 and diagonal members 22 (collectively referred to as members 28) are preferably made of wood. More preferably the members 28 are made of wood of the same width as studs in other parts of the light frame so that the shear wall panel 10 will be of the same width as the remainder of the wall. Further preferably, the members 28 are made of "2 by" nominal dimensional lumber which is usually more economical than using custom sized or larger dimension lumber. The "2 by" lumber may be doubled or tripled as required to withstand the design forces on the shear wall panel 10. For example, in shear wall panels 10 of up to 8 feet in width, the members 28 are typically made of doubled "2 by" lumber.

Although the members 28 may be nailed together, they are preferably connected with metal toothed plates 30 pressed or pounded into the members 28 wherever an end of one member 28 is adjacent another member 28. As in conventional stud framing, the upper horizontal member 18 and lower horizontal 20 extend to cover the overlap rather than the vertical members 12. It is preferred if the members 28 directly abut each other, but the toothed plates 30 advantageously allow for small spaces between members 28 to be joined together such that moderately imprecise joinery can be tolerated. The shear wall panel 10 is manufactured by cutting and placing the members 28 on a table or work surface, positioned as described above, and then pounding the toothed plates 30 into the members 28 in the places described above and shown in the Figures. The configuration of the shear wall panel 10 allows all of the metal plates 30 to be pressed or pounded from outside the perimeter of the shear wall panel 10 avoiding the need to create sub-assemblies or alternate between cutting and placing operations and pressing or pounding operations.

Figure 2:
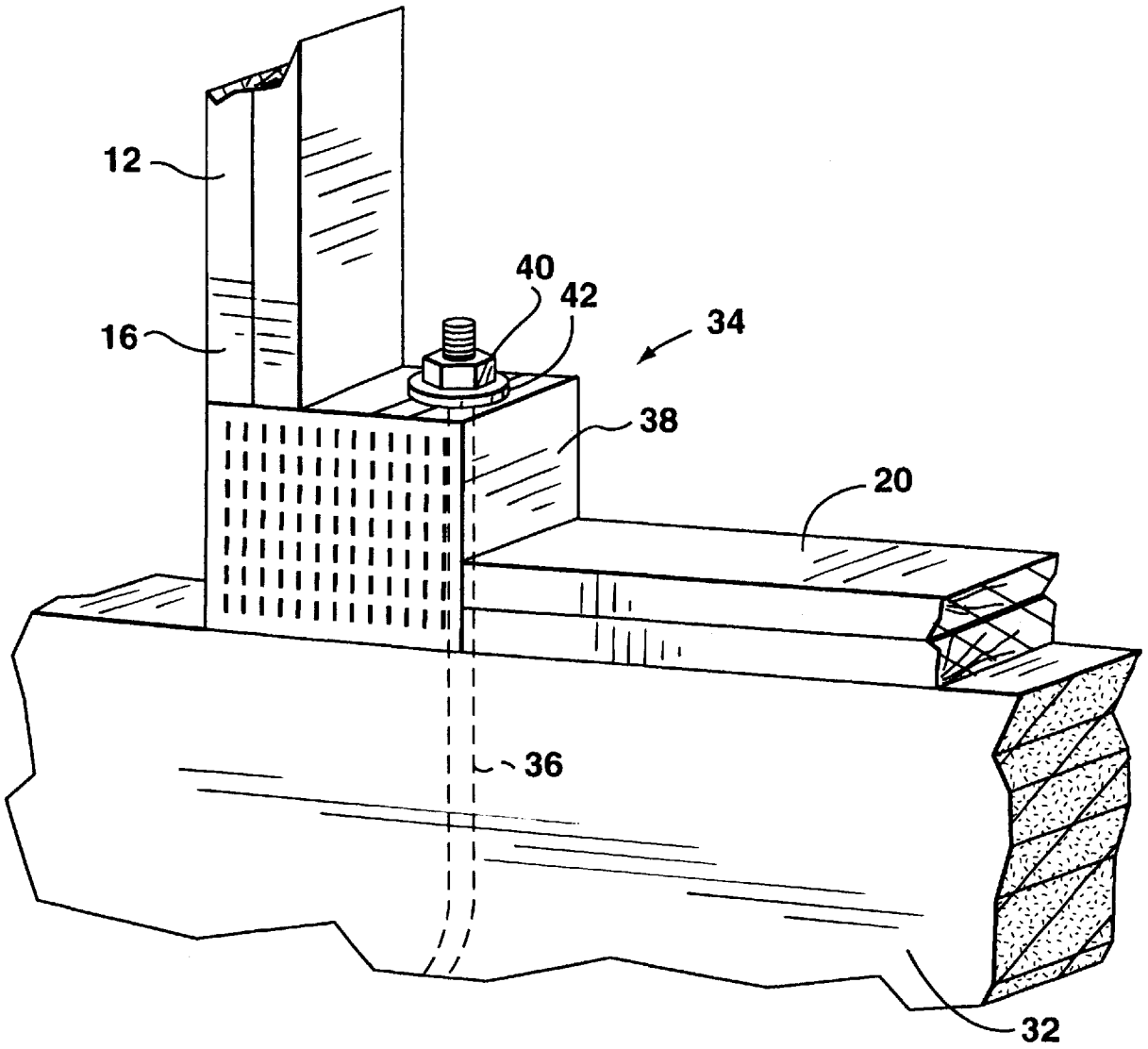
FIG. 2 is a perspective view of a portion of the shear wall panel of FIG. 1, the portion including a vertically oriented connecter according to an embodiment of the invention.

Referring still to FIG. 1, the shear wall panel 10 is shown attached to the foundation 32 of a building. The shear wall panel 10 may also be placed on top of a floor deck on top of the foundation 32 with suitable modifications to the description below. When a lateral force F is applied to the shear wall panel 10, it is resisted internally by compression stresses c and tensile stresses t and externally by reaction force R exerted by the foundation 32. Depending on the direction of lateral force F, either of the vertical members 12 can be placed in tension and tend to lift away from the foundation 32. To counteract this tendency, vertically oriented connections 34 adjacent the intersections between the lower horizontal member 20 and the lower ends 16 of the vertical members 12 connect the vertical members 12 to the foundation 32. Referring to FIGS. 1 or 2, the vertically oriented connection 34 is made of an anchor bolt 36 cast in the foundation 32 which passes through the lower horizontal member 20 and a vertically oriented connector 38, both of which have holes or spaces to admit the anchor bolt 36. A washer 42 is placed over the anchor bolt 36 followed by a nut 40 which is threaded onto the anchor bolt 36 to complete the connection to the foundation 32.

The vertically oriented connector 38 may be a thrust block made of wood preferably oriented so that the grain of the wood is substantially vertical to take advantage of the increased compressive strength of the wood parallel to the grain. Such a vertically oriented connector 38 is attached by a metal plate 30 to the lower end 16 of the vertical member 12. Preferably, the metal plate 30 covers substantially all of the thrust block to confine the thrust blocks deformation and increase its compressive strength. Further preferably, the same metal plate 30 also attaches to the lower horizontal member 20 to provide a secure connection between the vertical member 12 and the lower horizontal member 20.

Vertically oriented connector 38 made of wood as shown in FIGS. 1 and 2 are easily and inexpensively included in the shear wall panel 10 during manufacture. The thrust blocks shown in FIGS. 1 and 2 in particular are made of two blocks of "2 by" material with a space between them to accept the anchor bolts 36 thus avoiding the need to drill a hole through the thrust blocks while allowing the anchor bolt 36 to be near the vertical members 12 for low eccentricity. In narrow shear wall panels 10 (typically less than eight feet wide) under some loads, however, a wooden vertically oriented connector 38 may need to be larger than shown and have a plurality of holes for a plurality of anchor bolts 36 to provide sufficient strength. In these cases, suitable commercially available vertically oriented connectors 38 are preferred.

Additional foundation connections 44 are made of anchor bolts 36 cast in the foundation 32 which pass through the lower horizontal member 20 and are held in place by a nut 40 and washer 42. Where the shear wall panel 10 is attached to a floor attached to the foundation 32, the vertically oriented connections 34 and foundation connections 44 pass through the floor. In combination, the foundation connections 44, and vertically oriented connections 34 shear connect the shear wall panel 10, meaning that they transmit the reaction force R to the shear wall panel 10 and resist the tensile forces on the members 28 connected to the lower horizontal member 20. For the purposes of calculations, however, it is assumed that the vertically oriented connections 34 resist all of the tensile forces on the vertical members 12. Where the multi-segmented assembly 24 is a polygon, tensile forces on one diagonal member 22 are counteracted by adjoining diagonal members 22. In these cases, special vertically oriented connections 34 are typically not required where the diagonal members 22 attach to the lower horizontal member 20.

Depending on the exterior and interior wall coverings or fixtures, nailers 46 may be nailed into the shear wall panel 10 as required. Similarly, if a window is required in the shear wall panel 10, headers 48 and sills 50 can be nailed inside the shear wall panel 10. If these requirements are known early enough, the nailers 46, upper sills 48 and lower sills 50 can also be attached with metal plates when the shear wall panel 10 is assembled. In shear wall panels 10 of sufficient width, the open space in the centre of the shear wall panel 10 provides considerable architectural freedom for placing windows within a shear wall.

Despite the large opening in its centre, the shear wall panel 10 is surprisingly effective in supporting vertical loads on the wall. Vertical load is first supported by the upper horizontal member 18 and transferred to the vertical members 12 and to the vertex 26 of multi-segmented assembly 24 abutting the upper horizontal member 18. The upper diagonal members 22 further transmit vertical load to the lower portions of the vertical members 12. The lower diagonal members 22 counteract the lateral component of the force transferred by the upper diagonal members 22 so that the vertical members 12 are not bent laterally. Because the multi-segmented assembly 24 can support a vertical load, a large opening is provided without the need to design the upper horizontal member 18 as a conventional header.

Figure 3:
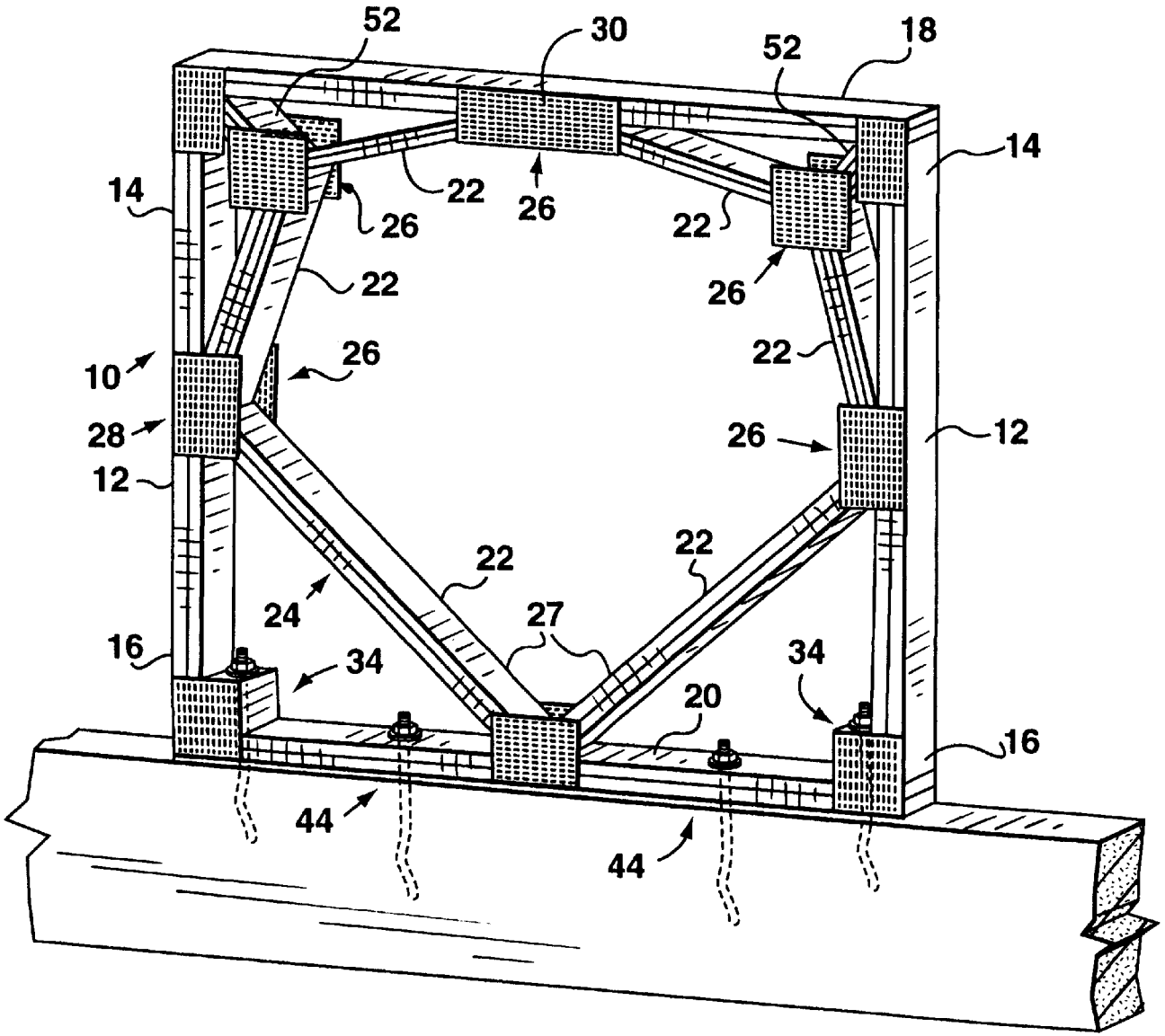
FIG. 3 is a perspective view of a shear wall panel according to another embodiment of the invention.
Figure 4:
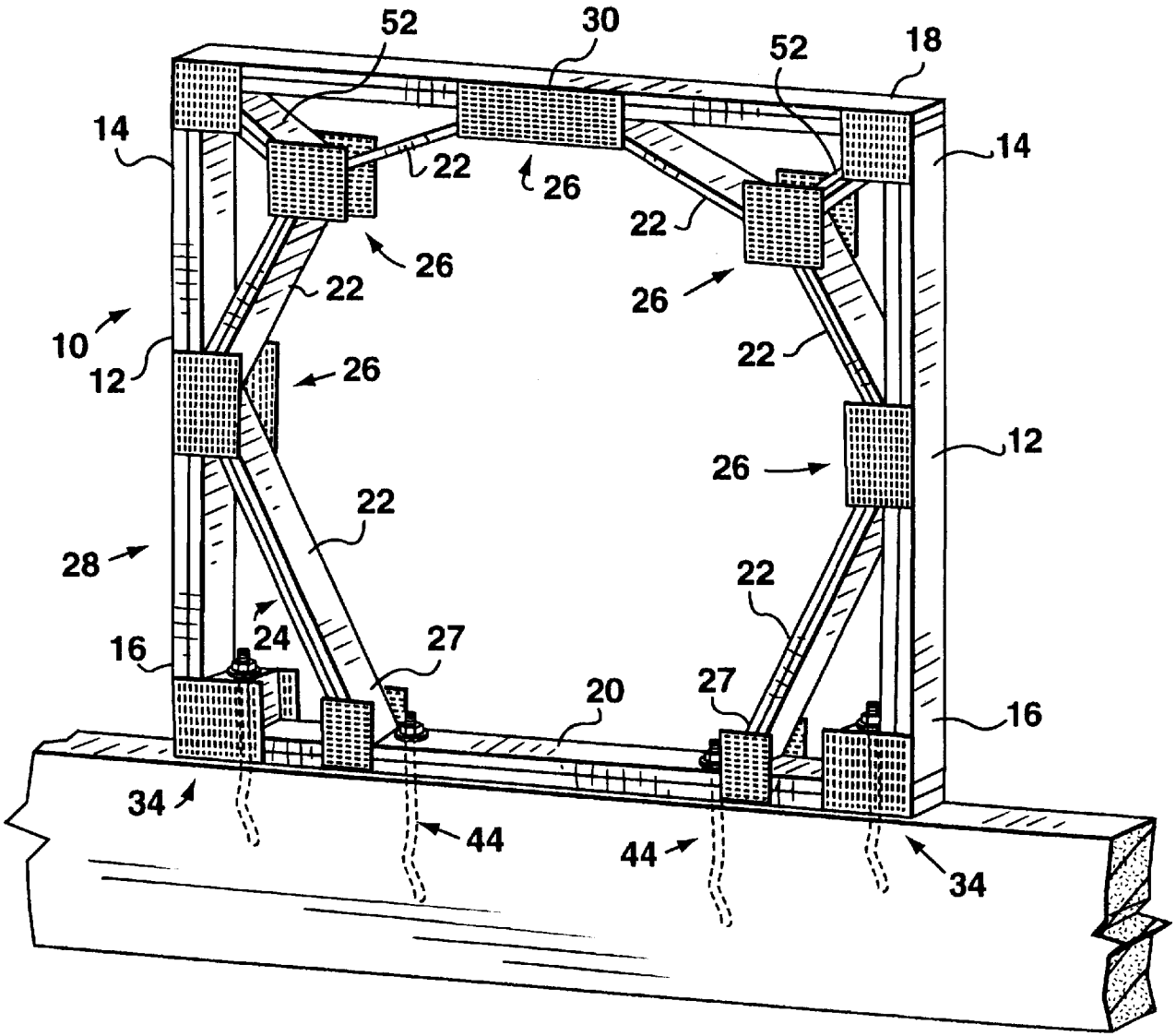
FIG. 4 is a perspective view of a shear wall panel according to another embodiment of the invention.

Referring now to FIGS. 3 and 4, alternate embodiments of the shear wall panel 10 are shown which provide even greater space for a window opening and, in the case of FIG. 4, for a door opening. In these Figures, the multi-segmented assembly 24 is formed of additional diagonal members 22 creating additional vertices 26. These additional vertices 26 are connected by extenders 52 to the vertically oriented connectors 38 or comers formed by the intersection of the vertical members 12 with either the upper horizontal member 18 or, not shown, the lower horizontal member 20. In other respects, the shear wall panels in FIGS. 3 and 4 are similar to the shear wall panel 10 in FIG. 1 although the distribution of internal forces differs slightly. In FIG. 4, an additional difference is that the first and second ends 27 of the multi-segmented assembly 24 are not joined to each other to make a polygon. In this case, shear forces on the shear wall panel 10 creates an upwards force at one of the first or second ends 27 that is not resisted by the other. To counter the upwards force, foundation connections 44 are placed adjacent the first and second ends 27. Depending on the load, however, additional vertically oriented connections 34 may be required in place of the foundation connections 44.

Figure 5:
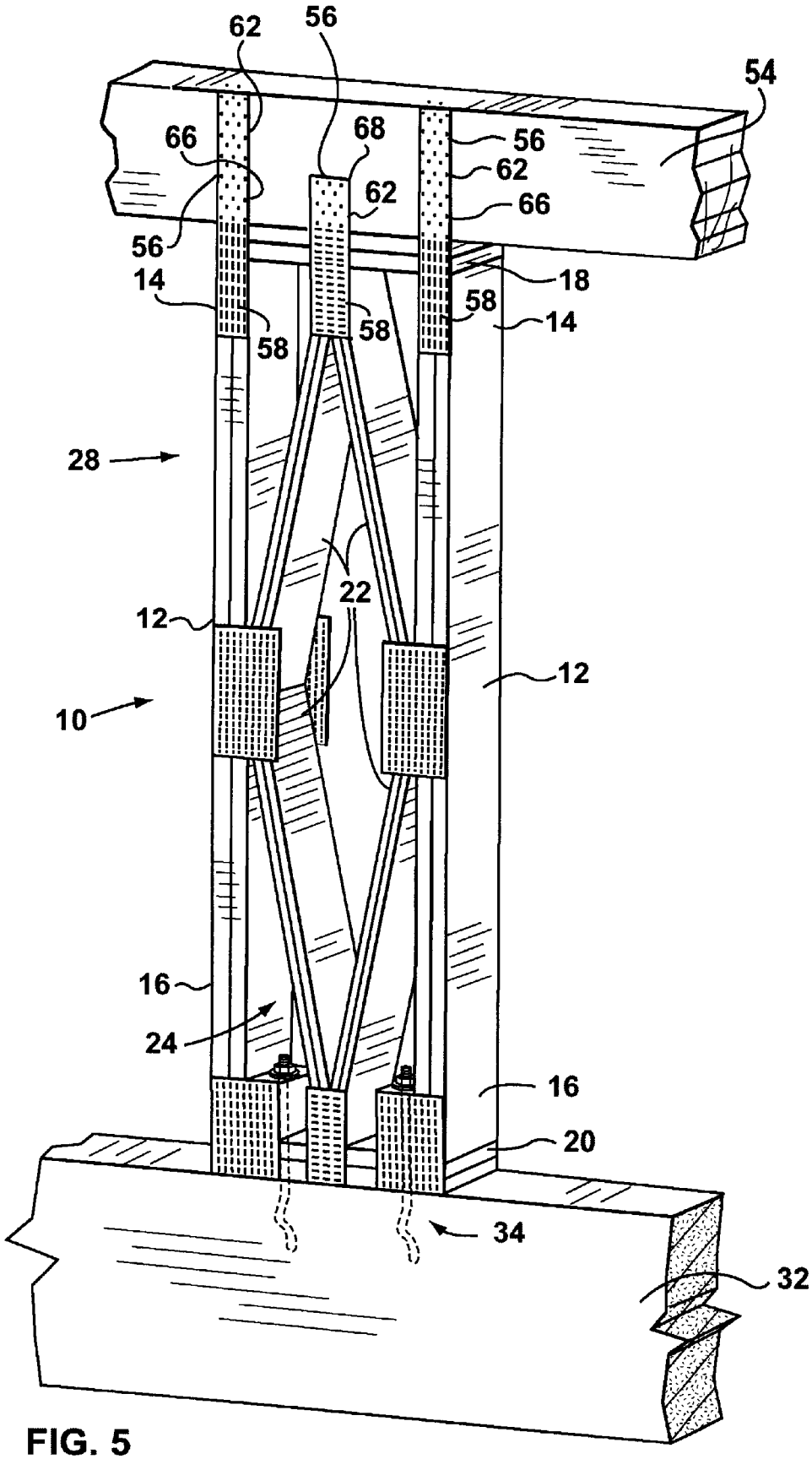
FIG. 5 is a perspective view of another embodiment of the invention showing metal plate connectors.

Referring now to FIG. 5, a shear wall panel 10 is shown attached to a superior structure 54 above it. The superior structure 54 could be, for example, a roof, a header over a large opening such as a garage door or the wall or floor of a second story. In a high wind or during an earthquake, for example, the superior structure 54 may be subject to a lateral force applied above the upper horizontal member 18. Accordingly, moment and shear forces will be created between the superior structure 54 and the upper horizontal member 18 of the shear wall panel 10. In other cases, such as where the superior structure 54 is a header over a large opening, similar moment and shear forces are created when a lateral force is applied anywhere to the structure. These forces are resisted by attaching the superior structure 54 and the upper horizontal member 18 together, preferably with strap connectors 56.

Figure 6:
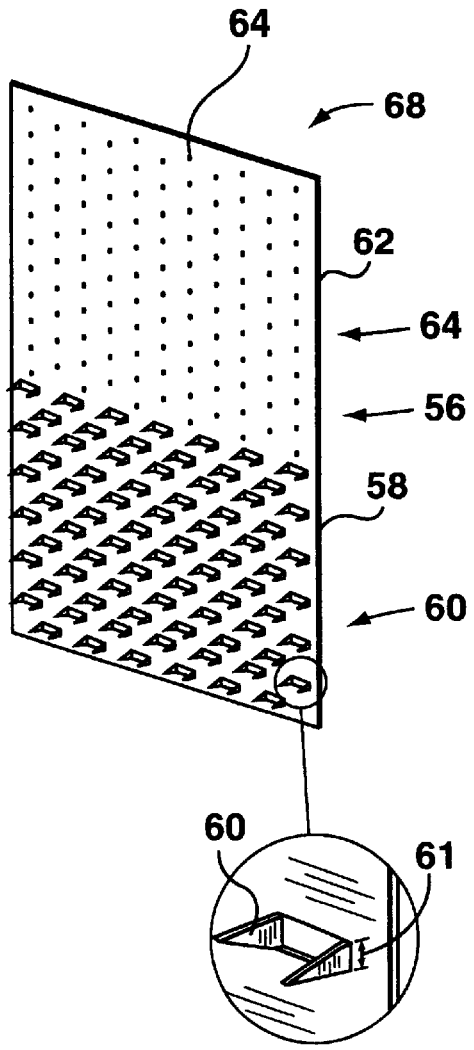
FIG. 6 is a perspective view of a shear connector according to an embodiment of the invention.
Figure 7:
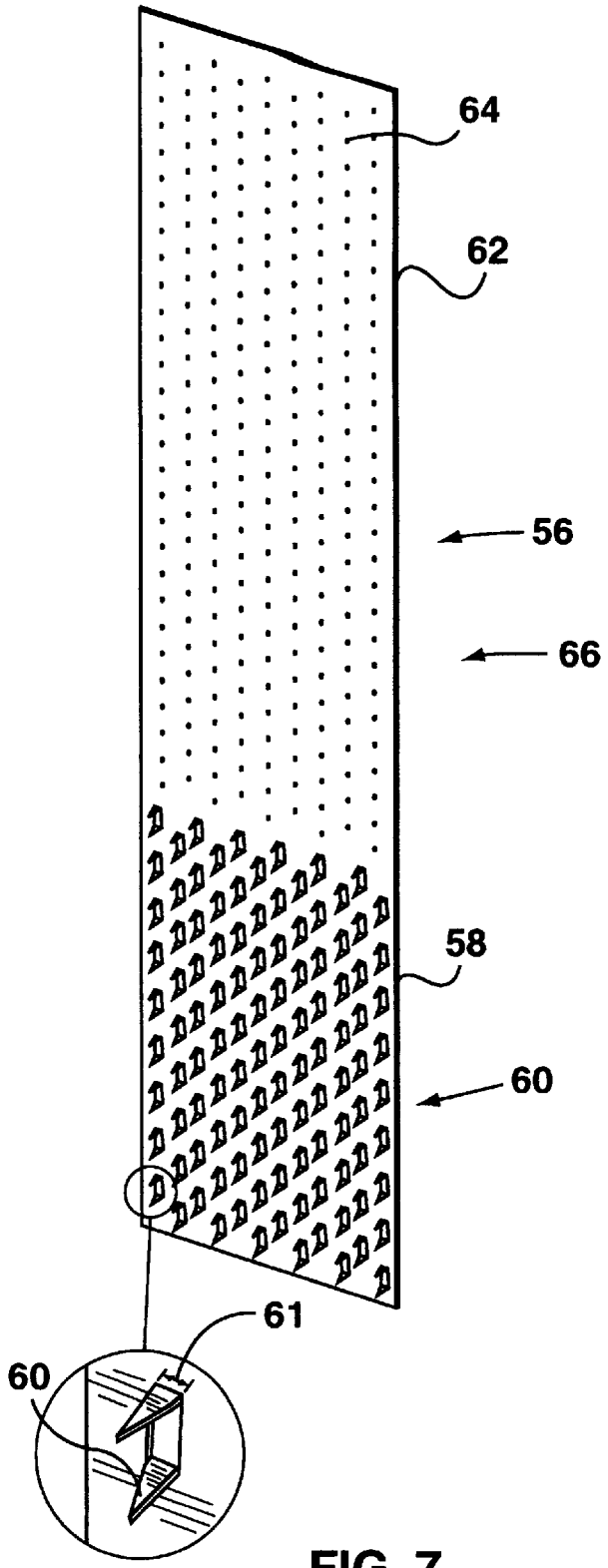
FIG. 7 is a perspective view of a tensile connector according to an embodiment of the invention.

Referring to FIGS. 5, 6 and 7, the strap connectors 56 are made of metal straps having a first portion 58 with teeth 60 bent out of the metal strap and a second portion 62 with holes 64 for nailing through the metal strap into the roof, floor or wall of the building. In FIG. 7, a tensile metal strap 66 is shown, having teeth 60 whose width 61 is parallel to a line dividing the first portion 58 of the strap connector 56 from the second portion 62 of the strap connector 56. As shown in FIG. 5, the first portion 58 of the tensile metal strap 66 is attached to the upper ends 14 of the vertical members 12 and the second portion 62 of the tensile metal strap 66 extends upwards from the shear wall panel 10 to be nailed to the superior structure 54. In FIG. 6, a shear metal strap 68 is shown having teeth 60 whose width 61 is perpendicular to a line dividing the first portion 58 of the strap connector 56 from the second portion 62 of the strap connector 56. The first portion 58 of the shear metal strap 68 is attached to the upper horizontal member 18 and the second portion 62 of the shear metal strap 68 extends upwards from the shear wall panel 10 to be nailed to the superior structure 54.

Figure 8:
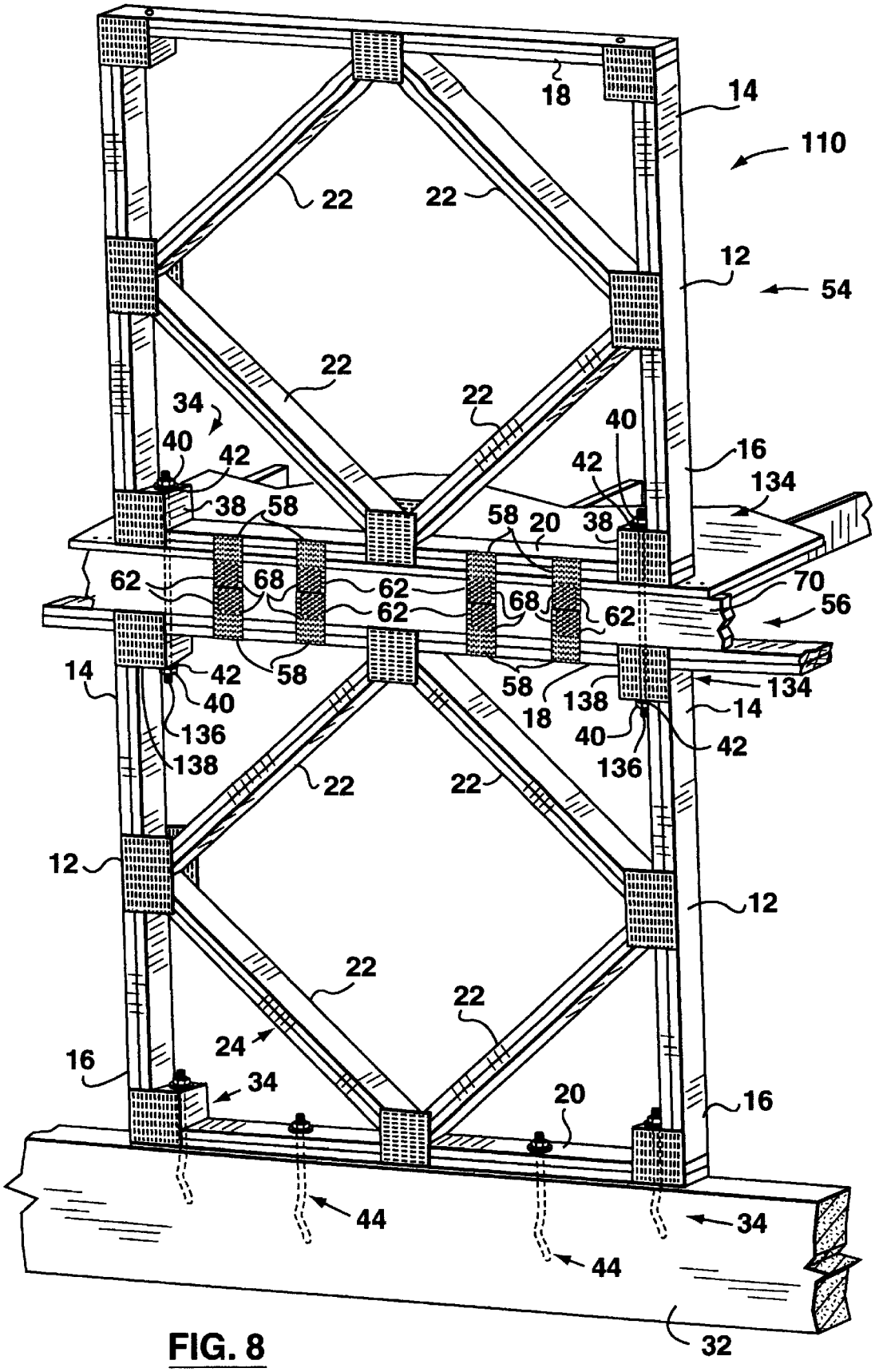
FIG. 8 is a perspective view of shear wall panels according to an embodiment of the invention in use in a first and second floor of a building.

Now referring to FIG. 8, a shear wall panel 10 on a first floor is attached to a second floor 70 of a superior structure 54. A second floor shear wall panel 110 is located above the shear wall panel 10 below, preferably such that their vertical members 12 are directly one above the other. The tensile metal straps 66 are not used, but rather second floor vertically oriented connectors 134 are used. The second floor vertically oriented connectors 134 are analogous to the vertically oriented connections 34 except that the foundation bolt 36 is replaced by a through bolt 136 threaded on both ends to receive nuts 40 and upper thrust blocks 138 are provided in the upper corners of the shear wall panel 10. The lower horizontal member 20 of the second floor shear wall panel 110 is shear connected to the laterally stabilized floor wall or floor below by the second floor vertically oriented connectors 134 and by shear metal straps 68. The first portion 58 of the shear metal straps 68 is attached to the lower horizontal member 20 and their second portion 62 extends downwards from the second floor shear wall panel 110 to be nailed to the second floor 70 or the shear wall panel 10 below. In this way, shear wall panels 10 can be provided for multistorey buildings efficiently at least up to 4 stories high.

To connect the shear wall panel 10 to an adjoining wall panel, upper-most board of the upper horizontal member 18 may be extended beyond the vertical members 12. This extended board laps over the top plate of an adjacent wall panel forming part of a conventional double top plate. Alternatively, as shown in FIG. 8, the entire upper horizontal member 18 may be extended beyond the vertical members 12 in which case the studs of an adjacent wall panel are attached directly to the extended upper horizontal member 18. Finally, the shear wall panel 10 can also be integrated into an adjacent wall panel by lapping one or more plates from the adjacent panel over the upper horizontal member 18 which involves more material than the methods above but avoids the need for extended upper horizontal members 18 which may be an advantage if the shear wall panels 10 are assembled off site.

It is to be understood that what has been described are preferred embodiments of the invention. The invention, however, may be altered and applied to alternative embodiments within the spirit of the invention as described above, and the scope of the claims set out below. In particular, the embodiments described above are suitable for use in light timber framing. It will be apparent to those skilled in the art, however, that the invention may be applied to other structural systems, particularly light gauge metal, engineered steel and timber framing.

I claim:

1. A shear wall panel for a building comprising, (I) outer rectangle members comprising, a) a pair of spaced apart vertical members having upper ends and lower ends;

b) an upper horizontal member extending between and secured to the upper ends of the vertical members; and, c) a lower horizontal member extending between and secured to the lower ends of the vertical members wherein the outer rectangle members form an outer rectangle; and, (II) inner polygon members comprising, d) at least four continuous diagonal members secured together end to end to form an inner polygon having at least a first, a second, a third and a fourth vertex, wherein (e) the inner polygon is located inside of the outer rectangle;

(f) the ends of the diagonal members of the first vertex abut each other and are secured to one of the vertical members;

(g) the ends of the diagonal members of the second vertex abut each other and are secured to the upper horizontal member;

(h) the ends of the diagonal members of the third vertex abut each other and are secured to the other vertical member;

(i) the ends of the diagonal members of the fourth vertex abut each other and are secured to the lower horizontal member;

(j) when more than four continuous diagonal members are present, any remaining ends of the continuous diagonal members abut the end of another continuous diagonal member and are secured to a first end of an extender member wherein the extender member has a second end secured to at least one outer rectangle member at a corner of the outer rectangle;

(k) the diagonal members, in combination with the outer rectangle members and any extender members, are adapted to resist lateral and vertical loads applied to the shear wall panel; and, (l) the shear wall panel is connected to a foundation or laterally stabilized wall or floor of the building below the shear wall panel so as prevent the vertical members from lifting away from the foundation or laterally stabilized wall or floor and transmit a lateral reaction force from the foundation or laterally stabilized wall or floor to the shear wall panel in response to an external lateral force applied to the upper horizontal member.

2. A shear wallpanel for a building comprising.

(i) outer rectangle members comprising, a) a pair of spaced apart vertical members having upper ends and lower ends;

b) an upper horizontal member extending between and secured to the upper ends of the vertical members; and, c) a lower horizontal member extending between and secured to the lower ends of the vertical members, wherein the outer rectangle members from an outer rectangle, (ii) vertically oriented connectors connected to each of the vertical members and adapted to each be secured to a bolt extending upwards from a foundation or laterally stabilized wall or floor of the building below the shear wall panel near each of the vertical members; and, (iii) inner polygon members comprising, d) at least four continuous diagonal members secured together end to end in a to form an inner polygon having at least a first, a second, a third and a fourth vertex, wherein (e) the inner polygon is located inside of the outer rectangle;

(f) the ends of the diagonal members of the first vertex abut each other and are secured to one of the vertical members;

(g) the ends of the diagonal members of the second vertex abut each other and are secured to the upper horizontal member;

(h) the ends of the diagonal members of the third vertex abut each other and are secured to the other vertical member;

(i) the ends of the diagonal members of the fourth vertex abut each other and are secured to the lower horizontal member;

(j) when more than four continuous diagonal members are present, any remaining ends of the continuous diagonal members abut the end of another continuous diagonal member and are secured to a first end of an extender member wherein the extender member has a second end secured to at least one outer rectangle member at a corner of the outer rectangle; and, (k) the diagonal members, in combination with the outer rectangle members and any extender members, are adapted to resist lateral and vertical loads applied to the shear wall panel.

3. The shear wall panel of claim 2 further comprising, metal straps each having a first portion which is attached to the upper horizontal member or the upper ends of the vertical members for attaching the shear wall panel to a roof, floor or wall of the building above the upper horizontal member.

4. The invention of claim 3 wherein the inner polygon members, the outer rectangle members and any extenders are made of wood and the metal straps each have a first portion which has teeth bent out of the metal strap, the second portion of which has holes without teeth for nailing through the metal strap into the roof, floor or wall of the building.

5. The invention of claim 4 wherein one or more of the metal straps are tensile metal straps each of which has teeth wherein the width of the teeth is parallel to a line dividing the first portion of the metal strap from the second portion of the metal strap, the first portion of the tensile metal strap is attached to the upper ends of the vertical members and the second portion of the tensile metal strap extends upwards from the shear wall panel.

6. The invention of claim 4 wherein one or more of the metal straps are shear metal straps having teeth wherein the width of the teeth is perpendicular to a line dividing the first portion of the metal strap from the second portion of the shear metal strap, the first portion of the shear metal strap is attached to the upper horizontal member and the second portion of the shear metal strap extends upwards from the shear wall panel.

7. The shear wall panel of claim 2 wherein, the members are made of wood, and secured to each other by toothed plates pounded into the members wherever one member is secured to another.

8. A method of making a shear wall for a building for resisting earthquake induced loads, comprising the steps of:

(i) providing a shear wall panel according to claim 2 adapted to resist earthquake loads;

(ii) placing the shear wall panel onto a foundation or laterally stabilized wall or floor of the building; and, (iii) bolting the vertical members of the shear wall panel to the foundation or laterally stabilized wall or floor with bolts adapted to resist uplift of the vertical members created in an earthquake.

9. A shear wall panel for a building comprising, (i) outer rectangle members comprising, a) a pair of spaced apart vertical members having upper ends and lower ends;

b) an upper horizontal member extending between and secured to the upper ends of the vertical members; and, c) a lower horizontal member extending between and secured to the lower ends of the vertical members, wherein the outer rectangle members from an outer rectangle, (ii) vertically oriented connectors connected to each of the vertical members and adapted to each be secured to a bolt extending upwards from a foundation or laterally stabilized wall or floor of the building below the shear wall panel near each of the vertical members; and, (iii) inner polygon members comprising, d) at least four continuous diagonal members secured together end to end in a to form an inner polygon having at least a first, a second, a third and a fourth vertex, wherein (e) the inner polygon is located inside of the outer rectangle;

(f) the ends of the diagonal members of the first vertex are secured to one of the vertical members;

(g) the ends of the diagonal members of the second vertex are secured to the upper horizontal members;

(h) the ends of the diagonal members of the third vertex are secured to the other vertical member;

(i) the ends of the diagonal members of the fourth vertex are secured to the lower horizontal member;

(j) when more than four continuous diagonal members are present, any remaining ends of the continuous diagonal members are secured to a first end of an extender member wherein the extender member has a second end secured to at least one outer rectangle member at a corner of the outer rectangle;

(k) the vertically oriented connectors are thrust blocks which comprise a block of wood oriented with the grain of the wood substantially vertical.

10. The invention of claim 9 wherein the thrust blocks comprise two blocks of wood spaced to accept a bolt extending upwards from the foundation or laterally stabilized wall or floor of the building below the shear wall panel.

11. A shear wall panel for a building comprising, (i) outer rectangle members comprising, a) a pair of spaced apart vertical members having upper ends and lower ends;

b) an upper horizontal member extending between and secured to the upper ends of the vertical members; and, c) a lower horizontal member extending between and secured to the lower ends of the vertical members, wherein the outer rectangle members from an outer rectangle, (ii) vertically oriented connectors connected to each of the vertical members and adapted to each be secured to a bolt extending upwards from a foundation or laterally stabilized wall or floor of the building below the shear wall panel near each of the vertical members; and, (iii) inner polygon members comprising, d) at least four continuous diagonal members secured together end to end in a to form an inner polygon having at least a first, a second, a third and a fourth vertex, wherein (e) the inner polygon is located inside of the outer rectangle;

(f) the ends of the diagonal members of the first vertex are secured to one of the vertical members;

(g) the ends of the diagonal members of the second vertex are secured to the upper horizontal member;

(h) the ends of the diagonal members of the third vertex are secured to the other vertical member;

(i) the ends of the diagonal members of the fourth vertex are secured to the lower horizontal member;

(j) when more than four continuous diagonal members are present, any remaining ends of the continuous diagonal members are secured to a first end of an extender member wherein the extender member has a second end secured to at least one outer rectangle member at a corner of the outer rectangle;

(k) the diagonal members, in combination with the outer rectangle members and any extender members, are adapted to resist lateral and vertical loads applied to the shear wall panel;

(l) the members are made of wood and secured to each other by toothed plates pounded into the members wherever one member is secured to another; and, the vertically oriented connectors are wooden thrust blocks.

12. The invention of claim 11 wherein the wooden thrust blocks comprise two blocks of wood spaced to accept a bolt extending upwards from a foundation or laterally stabilized wall or floor of the building below the shear wall panel.

13. A shear wall panel for a building comprising, a) first and second vertical members wherein the vertical members are horizontally spaced apart and each have an upper end and a lower end;

b) an upper horizontal member extending between and secured to the upper ends of the vertical members;

c) a lower horizontal member extending between and secured to the lower ends of the vertical members;

d) a continuous first diagonal member having a first end secured to the lower horizontal member and a second end secured to the first vertical member;

e) a continuous second diagonal member having a first end secured to and abutting the second end of the first diagonal member and secured to the first vertical member and a second end secured to the upper horizontal member;

f) a continuous third diagonal member having a first end secured to and abutting the second end of the second diagonal member and secured to the upper horizontal member and a second end secured to the second vertical member; and, g) a continuous fourth diagonal member having a first end secured to and abutting the second end of the third diagonal member and secured to the second vertical member and a second end secured to the lower horizontal member and secured to and abutting the first end of the first diagonal member, wherein h) the first, second, third and fourth diagonal members are located inside of a rectangle formed by the vertical and horizontal members; and, i) the shear wall panel is connected to a foundation or laterally stabilized wall or floor of the building below the shear wall panel so as prevent the vertical members from lifting away from the foundation or laterally stabilized wall or floor and transmit a lateral reaction force from the foundation or laterally stabilized wall or floor to the shear wall panel in response to an external lateral force applied to the upper horizontal member.

14. The shear wall panel of claim 13 wherein (a) the second end of the first diagonal member and the first end of the second diagonal member are secured to the first vertical member at about the midpoint of the first vertical member;

(b) the second end of the second diagonal member and the first end of the third diagonal member are secured to the upper horizontal member at about the midpoint of the upper horizontal member;

(c) the second end of the third diagonal member and the first end of the fourth diagonal member are secured to the second vertical member at about the midpoint of the second vertical member; and, (d) the first end of the first diagonal member and the second end of the fourth diagonal member are secured to each other and each secured to the lower horizontal member at about the midpoint of the lower horizontal member.

15. The shear wall panel of claim 14 having vertically oriented connectors secured to each of the vertical members wherein the vertically oriented connectors are adapted to each be secured to a bolt extending from a foundation or laterally stabilized wall or floor of the building below the shear wall panel.

16. The shear wall panel of claim 14 wherein the members are made of pieces of wood and all members are secured to each other by toothed plates pounded into the members.

17. A shear wall panel for a building comprising, a) first and second vertical members wherein the vertical members are horizontally spaced apart and each have an upper end and a lower end;

b) an upper horizontal member extending between and secured to the upper ends of the vertical members;

c) a lower horizontal member extending between and secured to the lower ends of the vertical members;

d) a continuous first diagonal member having a first end secured to the lower horizontal member and a second end secured to the first vertical member;

e) a continuous second diagonal member having a first end secured to the second end of the first diagonal member and the first vertical member and a second end secured to the upper horizontal member;

f) a continuous third diagonal member having a first end secured to the second end of the second diagonal member and the upper horizontal member and a second end secured to the second vertical member; and, g) a continuous fourth diagonal member having a first end secured to the second end of the third diagonal member and the second vertical member and a second end secured to the lower horizontal member and the first end of the first diagonal member, h) having vertically oriented connectors secured to each of the vertical members wherein the vertically oriented connectors are adapted to each be secured to a bolt extending from a foundation or laterally stabilized wall or floor of the building below the shear wall panel, wherein i) the first, second, third and fourth diagonal members are located inside of a rectangle formed by the vertical and horizontal members; and, j) the shear wall panel is connected to a foundation or laterally stabilized wall or floor of the building below the shear wall panel so as prevent the vertical members from lifting away from the foundation or laterally stabilized wall or floor and transmit a lateral reaction force from the foundation or laterally stabilized wall or floor to the shear wall panel in response to an external lateral force applied to the upper horizontal member;

k) the members are made of pieces of wood of about the same width;

l) the vertically oriented connectors each comprise two thrust block members each made of wood of about the same width as the other members;

m) the grain of the wood in the thrust blocks is substantially vertical;

n) the thrust block members are spaced to accept a bolt extending upwards from the foundation or laterally stabilized wall or floor of the building below the shear wall panel; and, o) all members are secured to each other by toothed plates pounded into the members.

* * * * *